United States Patent [19]

Godyak

[11] Patent Number: 4,792,727

[45] Date of Patent: Dec. 20, 1988

[54] SYSTEM AND METHOD FOR OPERATING A DISCHARGE LAMP TO OBTAIN POSITIVE VOLT-AMPERE CHARACTERISTIC

[75] Inventor: Valery A. Godyak, Bradford, Mass.

[73] Assignee: GTE Products Corporation, Danvers, Mass.

[21] Appl. No.: 104,185

[22] Filed: Oct. 5, 1987

[51] Int. Cl.[4] ..... H05B 37/00

[52] U.S. Cl. ..... 315/176; 315/171; 315/172; 315/174; 315/205; 315/105

[58] Field of Search ..... 315/171, 172, 174, 175, 315/176, 94, 105, 106, 200 R, 205, 206

[56] References Cited

U.S. PATENT DOCUMENTS

| | | | |
|---|---|---|---|
| 3,521,122 | 7/1970 | Peek, Jr. | 315/176 X |
| 3,525,901 | 8/1970 | Sammis | 315/105 |
| 3,819,981 | 6/1974 | Diamond | 315/171 X |
| 4,051,407 | 9/1977 | Van der Werf et al. | 315/106 |
| 4,450,380 | 5/1984 | Proud et al. | 313/485 |

OTHER PUBLICATIONS

Waymouth, "Electric Discharge Lamps," pp. 28–29, MIT Press, 1958.

*Primary Examiner*—David K. Moore
*Assistant Examiner*—Mark R. Powell
*Attorney, Agent, or Firm*—Carlo S. Bessone

[57] ABSTRACT

A system and associated method for operating a gas discharge lamp so as to provide a positive voltage-current characteristic. An AC or DC source is used to provide electron heating, without in itself providing ionization, of the lamp gas. Superimposed on this signal is a pulsed source of power having an average output power substantially less than the AC or DC source power for providing ionization of the lamp gas.

20 Claims, 2 Drawing Sheets

SYSTEM AND METHOD FOR OPERATING A DISCHARGE LAMP TO OBTAIN POSITIVE VOLT-AMPERE CHARACTERISTIC

TECHNICAL FIELD

The present invention relates in general to a system and method for operating a discharge lamp such as a rare gas-mercury discharge lamp. More particularly, the present invention pertains to a system and method for controlling a discharge lamp so as to provide a positive voltage-current characteristic enabling lamp operation without the requirement for a lamp ballast.

BACKGROUND OF THE INVENTION

It is known that the volt-ampere (V/I) characteristic of an electrical discharge, particularly for a fluorescent lamp, has a very low or even negative differential resistance, expressed as $R_d=dV/dI$, which is much smaller than its static resistance, expressed as $R_s=V/I$. This aspect of the discharge makes it necessary to employ a ballast to provide additional resistance for stable operation of the lamp from a source of voltage (source with a very low output resistance). For AC operation an inductive ballast is used for reducing ballast energy loss.

The nature of the low differential resistance of the discharge is that the plasma density and conductance of the discharge is nearly proportional to discharge current for slow changes of discharge current when plasma density is in equilibrium with the current. On the other hand, for fast current variation, for a time much less than the diffusion time $T_d$ (for fluorescent lamp $T_d$ is in the order of lms), the plasma density in nearly constant during a period of the AC signal. The instantaneous current-voltage characteristic of such a discharge is almost linear. Thus, by operating in this manner the differential resistance and static resistance are about equal. Thus, it is typical to provide high frequency lamp operation, say in a frequency range of 25–50 KHz. This is implemented by an electronic ballast which is essentially a high frequency signal generator with output power equal to the lamp discharge power. There are several drawbacks associated with a conventional high frequency electronic ballast including by way of example, their complexity and cost which follows from the requirement of total lamp power generation.

BRIEF SUMMARY OF THE INVENTION

One object of the present invention is to provide a system and associated method for operating a discharge lamp without requiring a lamp ballast.

Another object of the present invention is to provide a system and method in accordance with the preceding object and in which the volt-ampere characteristic is controlled to be positive thus permitting operation without a ballast.

A further object of the present invention is to provide a system and method for operating a discharge lamp in which the lamp electric field and electron temperature are controlled in a wide range of parameters by changing (controlling) source current which may be either DC or AC current.

Still another object of the present invention is to provide an improved form of control for operating a discharge lamp with very small average power particularly in comparison to the output power of the lamp.

In accordance with a main aspect of the invention, there is provided, a system for controlling a gas plasma discharge lamp to provide a positive voltage-current characteristic to permit the lamp operation without the requirement for a ballast. The system of the invention includes means coupled to the lamp and defining a first source of power to provide electron heating, without in itself providing ionization, of the lamp gas. This first source may either comprise a DC source or an AC source. Means are also provided coupled to the lamp and defining a second source which is a pulsed source of power having an average output power substantially less than the output power of the first source. The second source is used to provide ionization of the lamp gas. The average output power of the pulsed source is at least an order of magnitude less than the average power of the AC/DC source. To provide sufficient voltage amplitude for ionization, the amplitude of the pulse from the pulsed source is greater than the steady state lamp voltage. The frequency of the pulsed source is characterized by having its period between pulses be less than the diffusion time constant of the lamp plasma. This pulse frequency is preferably greater than 1 KHz. The pulse width of the pulse from the pulsed source is narrow and substantially less than the period of the pulses. In this connection, the duty cycle of the pulsed source is substantially less than unity and in one disclosed embodiment is on the order of 1/300. The system of the present invention may also include isolation means coupling each source to the lamp. This may be in the form of a unilateral conducting means such as a diode in the path from each source.

In accordance with a further aspect of the present invention there is provided a method of controlling a gas discharge lamp to provide a positive voltage-current characteristic to permit lamp operation without a ballast. This method comprises the steps of impressing on the lamp at least one of an AC and DC power signal of a magnitude capable of only providing a non-self-sustaining regime of operation to provide electron heating without ionization of the plasma. Next is the step of superimposing on the lamp a low power pulsed signal to provide ionization of the plasma. The average output power of the pulsed signal is substantially less than the average output power of the power signal. The average output power of the pulsed signal is preferably at least an order of magnitude less than the average output power of the power signal. The amplitude of the pulsed source is greater than the steady state lamp voltage. The frequency of the pulsed source is characterized by the period thereof between pulses being less than the deionization time constant of the lamp plasma. The pulse width of the pulses from the pulsed source is narrow and substantially less than the period of the pulses. In this connection the duty cycle of the pulsed source is substantially less than unity and in the disclosed embodiment is on the order of 1/300.

BEST MODE FOR CARRYING OUT THE INVENTION

For a better understanding of the present invention together with other and further objects, advantages and capabilities thereof, reference is made to the following disclosure and appended claims in connection with the above described drawings.

The present invention relates to a system and associated method for operating a gas discharge lamp in a manner to obtain a positive voltage-current characteristic with controlled electron temperature. The attaining of this positive voltage-current characteristic enables one to operate without a ballast, although, a ballast impedance may be employed. This operation is carried out in accordance with the invention by means of a combined power and pulse discharge. The power source may be either a DC source or an AC source. This is combined with pulsed source operation. In this connection the narrow high voltage pulses perform ionization of the plasma in the discharge lamp while the DC or AC source provides electron heating, without ionization.

The combined form of lamp control in accordance with the invention permits the possibility of controlling electric field and electron temperature in a wide range of values, primarily by changing the DC or AC current. Furthermore, the average pulse power is much less than the DC or AC power and thus only a small average pulse power can be used to provide the main control function.

Figure 1:
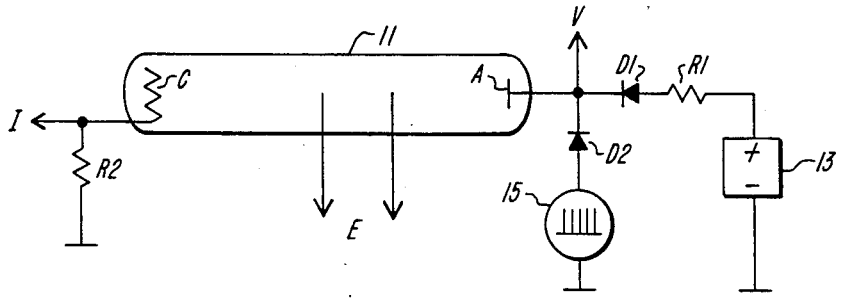
FIG. 1 is a circuit diagram illustrating basic arrangement for describing the concepts of the present invention for operating a discharge lamp.

In connection with the concepts of the present invention, reference is now made to the schematic circuit diagram of FIG. 1. FIG. 1 also illustrates where the lamp voltage V is taken as well as where the lamp current I is taken.

In the schematic circuit diagram of FIG. 1 there is shown the gas discharge lamp 11 having at respective ends thereof the anode A and cathode C. The cathode C couples to the cathode resistor R2. On the anode side of the lamp there is connected the DC source 13 coupled by way of resistor R1 and diode D1 to the anode A. Also connected on the anode side of the lamp is the pulse generator 15 which is coupled by way of diode D2 to the anode A. In FIG. 1 the diodes D1 and D2 provide isolation between the DC source 13 and the pulse generator 15. FIG. 1 also shows how the E-field was measured across a pair of probes sealed in the lamp 11. The voltage V is measured at the anode of the lamp and the current I is measured at the cathode of the lamp.

Figure 2:
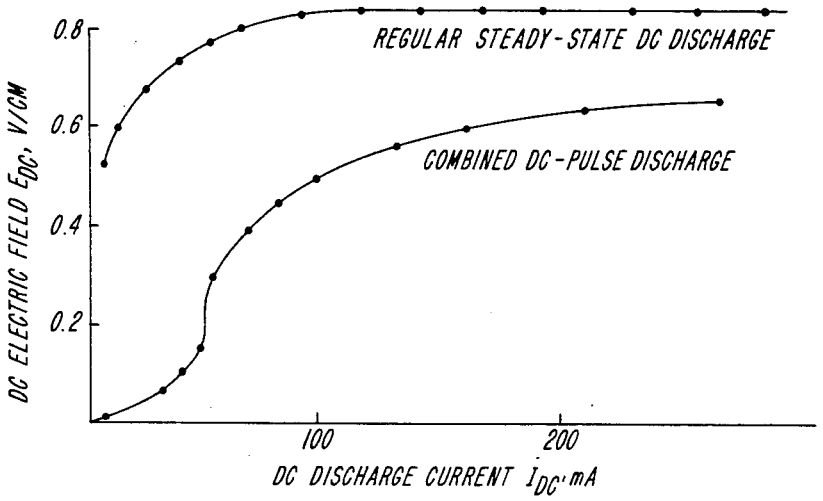
FIG. 2 illustrates plots of DC discharge current versus DC electric field in association with the circuit of FIG. 1 for both regular steady state DC discharge and combined DC-pulse discharge.
Figure 3:
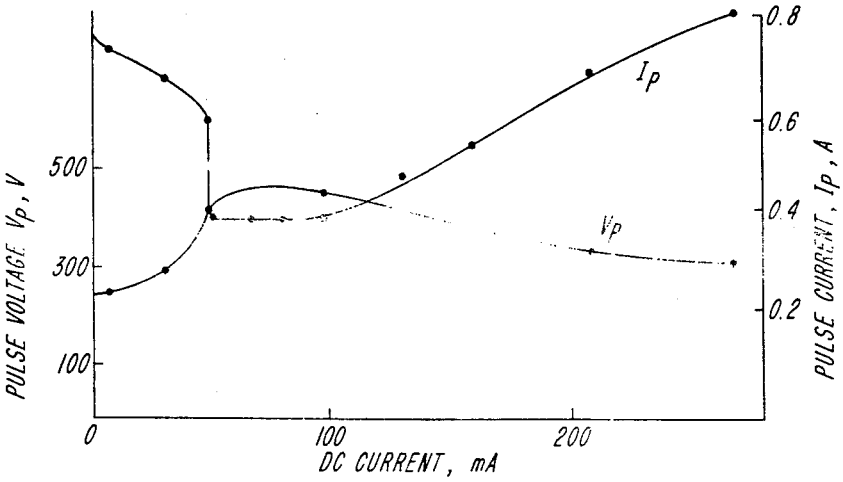
FIG. 3 illustrates curves also associated with the circuit of FIG. 1 plotting both pulsed current and pulsed voltage as functions of the DC current.

In connection with the schematic circuit of FIG. 1 the results of DC and pulse measurements are illustrated respectively in FIGS. 2 and 3. In connection with these measurements reference is made hereinafter to FIG. 4 for a more complete set-up of the measurement devices. It is noted in FIG. 2 that this is a plot or discharge current versus electric field showing at the top the regular steady state DC discharge for a lamp and showing at the bottom the discharge waveform in accordance with the present invention employing combined DC and pulse discharge. It is noted from FIG. 2 that by applying pulses to the DC discharge there is a significant change in the DC volt-ampere characteristic making it positive. Note in the top waveform in FIG. 2 that the slope is substantially zero while in the lower waveform the slope thereof is positive indicating a positive volt-ampere characteristic. FIG. 3 is a plot also of the measured pulse voltage and pulse current versus DC current through the lamp.

There are a number of parameters that are controlled in accordance with the present invention to provide the desired mode of operation. From the plots of FIGS. 2 and 3 calculations can be made to compare DC and average pulse powers of the discharge operating with the positive volt-ampere characteristic. In this connection refer to FIG. 5 for a representative pulse waveform. This shows a pulse output of square wave pulses with a pulse width of 1.0 microseconds and a duty cycle or duty factor of 1/300. Note that the period of the pulses is 300 microseconds. For a DC current of 264 milliamps the average pulse power $P_p$ is 7.5 mW/cm, while the DC power $P_{dc}$ is 176 mW/cm. The ratio of these powers may be defined as a controlling factor in which the ratio of $P_{dc}/P_p$ for the above example is 23.4.

Stated in another way, it is desired to have the average pulse power very small in comparison to the DC power. In this way one can, with a very small input power control a substantially larger power delivered to the lamp. The aforementioned controlling factor is preferably substantially greater than unity.

Thus, as far as input power is concerned from the pulse generator, it is noted that a positive volt-ampere characteristic of the discharge is attained with only a small external pulse source that comprises only a few percent, say on the order of 4 percent, of the total input power from both sources.

Even though the average pulse power is small, in order to maintain proper plasma conductivity the pulses that are applied have to be of sufficient amplitude to provide an average ionization power sufficient to maintain the plasma. In this connection the pulse amplitude selected is to be several times higher than the lamp steady state voltage. In one construction the lamp steady state voltage is 80 volts and the applied pulse has an amplitude of 200 volts or greater. Note in FIG. 5 the indication of pulse amplitude of 300 volts. Related to the pulse amplitude is the duty cycle of the waveform. In order to provide the sufficiently high controlling factor, then the duty cycle of operation is quite small. In the example illustrated in FIG. 5 the duty cycle or duty factor is 1/300. The duty cycle has to be substantially less than unity.

Figure 5:
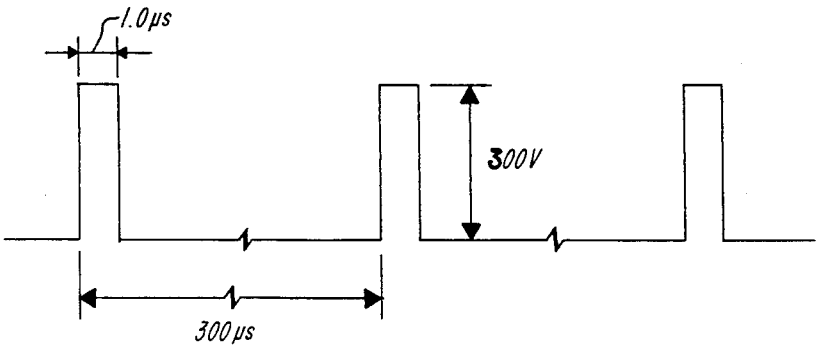
FIG. 5 is a pulse waveform thay may be employed in accordance with the present invention.

One other parameter relating to the waveform of FIG. 5 is the frequency of operation. The pulses are to be applied with a frequency of repetition so that the time between pulses is less than the decay or deionization time of the plasma. This is important in maintaining proper plasma conductivity. Stated in another way, the frequency of repetition has to be greater than $T_d^{-1}$. In this way, one obtains pulsed discharge with nearly constant plasma density. If this pulsed operation is used alone the electron temperature of this discharge would be very low (about room temperature) in the period between pulses because of the small time relaxation of the electron temperature. However, by applying additional DC or AC voltage superimposed on this pulse discharge, one can increase the electron temperature up to a level which is sufficient for UV radiation of the discharge. Because the plasma density and conductivity of the discharge do not increase with AC or DC current, the current-voltage characteristic of the discharge is positive with the differential resistance being approximately equal to the static resistance thus eliminating the need for an associated lamp ballast. To maintain the discharge in this non-self-sustaining mode of operation and to furthermore provide a positive current-voltage characteristic, the AC or DC electric field (supply voltage of the discharge) is lower than is the case for the steady state regime. This is illustrated in FIG. 2 in which it is noted that the electric field is less in the case of the combined discharge.

With respect to the discharge lamp 11, this may be a neon-mercury discharge lamp with a neon pressure of 1 TORR and a mercury pressure corresponding to room temperature. Alternatively, the principles of the invention may be applied in other types of discharge lamps including fluorescent lamp.

From the foregoing, one might assume that the combined discharge is not efficient for UV generation because the electric field and the electron temperature in it are lower than in the steady state discharge. Assuming that an existing fluorescent lamp opeates at an optimal product of pR (p=gas pressure, R=discharge radius) this provides an optimal ratio of E/p (E=electric field) for maximum light output. One can reach the same magnitude of E/p in a non-self-sustaining discharge, by using a smaller quantity pR for which a steady state magnitude of E/p is larger than the optimal one.

Figure 4:
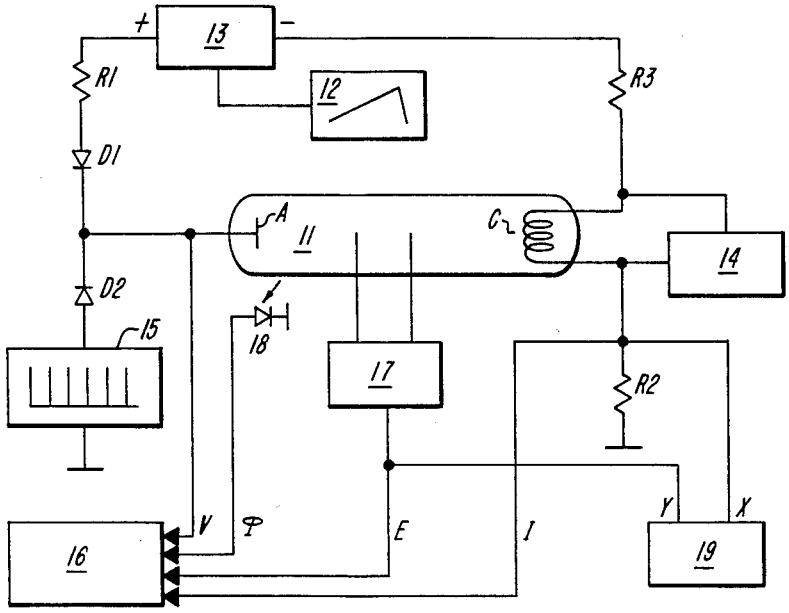
FIG. 4 is a circuit diagram similar to the diagram of FIG. 1 but also illustrating all of the devices for taking measurements.

Reference is now made to the circuit diagram of FIG. 4. In FIG. 4 the same reference characters are used to identify the same components previously referenced in FIG. 1. Thus, in FIG. 4 there is illustrated the gas discharge lamp 11 with its anode A and cathode C. The discharge power supply 13 is illustrated coupled to the lamp by way of resistor R1 and R3 and diode D1. A ramp generator 12 controls the discharge power supply. The pulse generator 15 also couples to the lamp 11 by way of the diode D2. On the cathode side of the lamp there is provided the cathode heating power supply 14. The resistor R2 serves for pulse current measurement.

FIG. 4 also illustrates the oscilloscope 16 that is used for the display of the different parameters identified in FIG. 4. This includes the voltage of the lamp, namely voltage V as well as the light output from the lamp as measured by the photodiode 18. There is also provide a differential probe 17 for measurement of the electric field, namely electric field E, also coupled to the oscilloscope as illustrated in FIG. 4. Finally, there is provided an X-Y recorder for DC current-voltage characteristic. The current is sensed at the resistor R2 and the current I is also coupled to the oscilloscope 16. Both this signal and the electric field signal couple to the recorder 19.

Thus, in summary, in accordance with the present invention there is provided a form of control for the operation of a discharge lamp in which the control is in a non-self-sustaining discharge regime. The operation of the lamp is by a combined form of discharge including power discharge and pulsed discharge. Short term pulses perform ionization while a DC or AC source provides electron heating without ionization. The pulse power, which is generally only a very small percentage of overall lamp power provides only the control function of the discharge. A positive volt-ampere characteristic is obtained without the need for a ballast.

While there have been shown and described what are at present considered the preferred embodiments of the invention, it will be obvious to those skilled in the art that various changes and modifications may be made therein without departing from the scope of the invention as defined by the appended claims.

What is claimed is:

1. A system for controlling a gas discharge lamp to provide a positive voltage-current characteristic to permit stable lamp operation without a ballast, said system comprising, means coupled to said lamp and defining a first source of power to provide electron heating, without in itself providing ionization, of the lamp gas, and means also coupled to said lamp and defining a second pulsed source of power having an average output power substantially less than the first source output power to provide ionization of the lamp gas and having a duty cycle substantially less than unity.

2. A system as set forth in claim 1 wherein said first source comprises a DC source.

3. A system as set forth in claim 1 wherein said first source comprises an AC source.

4. A system as set forth in claim 1 wherein the average output power of the second source is at least an order of magnitude less than the average output power of the first source.

5. A system as set forth in claim 1 wherein the amplitude of the pulsed source is greater than the steady state lamp voltage.

6. A system as set forth in claim 1 wherein the frequency of the pulsed source is characterized by the period between pulses being less than the deionization time constant of the lamp plasma.

7. A system as set forth in claim 6 wherein the pulse width of the pulse from the pulsed source is narrow and substantially less than the period of the pulses.

8. A system as set forth in claim 7 wherein the duty cycle is on the order of 1/300.

9. A system as set forth in claim 1 wherein the pulse width of the pulses from the pulsed source is narrow and substantially less than the period of the pulses.

10. A system as set forth in claim 1 wherein the duty cycle is on the order of 1/300.

11. A system as set forth in claim 1 wherein the second source comprises a pulse generator.

12. A system as set forth in claim 1 including isolation means coupling each source to said lamp.

13. A system as set forth in claim 12 wherein said isolation means comprises a unilaterally conducting means.

14. A system as set forth in claim 13 wherein said unilateral conducting means includes a diode.

15. A method of controlling a gas discharge lamp to provide a positive voltage-current characteristic to permit lamp operation without a ballast, said method comprising the steps of, impressing on the lamp at least one of an AC and DC power signal of a magnitude capable of only providing a non-self-sustaining regime of operation to provide electron heating without ionization of the plasma, and superimposing on the lamp a low power pulsed signal from a pulsed source to provide ionization of the plasma wherein the average output power of the pulsed signal is substantially less than the average output power of the power signal and wherein the duty cycle of the pulsed source is substantially less than unity.

16. A method as set forth in claim 15 wherein the average output power of the pulsed signal is at least an order of magnitude less than the average output power of the power signal.

17. A method as set forth in claim 15 wherein the amplitude of the pulsed source is greater than the steady state lamp voltage.

18. A method as set forth in claim 15 wherein the frequency of the pulsed source is characterized by the period between pulses being less than the diffusion time constant of the lamp plasma.

19. A method as set forth in claim 15 wherein the pulse width of the pulses from the pulsed source is narrow and substantially less than the period of the pulses.

20. A method as set forth in claim 15 wherein the duty cycle is on the order of 1/300.

* * * * *